US011096250B2

(12) United States Patent
Nakamura et al.

(10) Patent No.: US 11,096,250 B2
(45) Date of Patent: Aug. 17, 2021

(54) CERAMIC HEATER AND MANUFACTURING METHOD FOR SAME

(71) Applicant: NGK SPARK PLUG CO., LTD., Nagoya (JP)

(72) Inventors: Shotaro Nakamura, Iwakura (JP); Yusuke Makino, Kasugai (JP); Noriyuki Ito, Iwakura (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 491 days.

(21) Appl. No.: 15/519,586

(22) PCT Filed: Oct. 29, 2015

(86) PCT No.: PCT/JP2015/080567
§ 371 (c)(1),
(2) Date: Apr. 17, 2017

(87) PCT Pub. No.: WO2016/068242
PCT Pub. Date: May 6, 2016

(65) Prior Publication Data

US 2017/0245324 A1 Aug. 24, 2017

(30) Foreign Application Priority Data

Oct. 31, 2014 (JP) ..... JP2014-223043

(51) Int. Cl.
*H05B 3/18* (2006.01)
*H05B 3/78* (2006.01)
(Continued)

(52) U.S. Cl.
CPC ..... *H05B 3/18* (2013.01); *H05B 1/0297* (2013.01); *H05B 3/06* (2013.01); *H05B 3/12* (2013.01);
(Continued)

(58) Field of Classification Search
None
See application file for complete search history.

(56) References Cited

U.S. PATENT DOCUMENTS 1,425,845 A * 8/1922 Foster ..... B25B 13/10 81/176.15
2,951,929 A * 9/1960 Fox ..... H05B 3/06 219/541
(Continued)

FOREIGN PATENT DOCUMENTS

CN 101456753 A 6/2009
JP S57-200261 A 12/1982
(Continued)

OTHER PUBLICATIONS

Japan Patent Office, International Search Report issued in corresponding Application No. PCT/JP2015/080567, dated Jan. 26, 2016.
(Continued)

*Primary Examiner* — Ibrahime A Abraham
*Assistant Examiner* — Elizabeth M Sims
(74) *Attorney, Agent, or Firm* — Sites & Harbison, PLLC; Jeffrey A. Haeberlin; James R. Hayne

(57) ABSTRACT

A ceramic heater according to one aspect of the present invention has a cylindrical ceramic heater and an annular metal flange fitted around the ceramic heater. In the ceramic heater, one side of the flange with respect to an axial direction of the heater body is concave in the axial direction to define a concave part. The concave part includes a glass accumulation region filled with a glass material. The glass material in the glass accumulation is fused to the flange and to the heater body.

17 Claims, 11 Drawing Sheets

(51) Int. Cl.

| | |
|---|---|
| ***H05B 3/06*** | (2006.01) |
| ***H05B 3/46*** | (2006.01) |
| ***H05B 3/52*** | (2006.01) |
| ***H05B 3/34*** | (2006.01) |
| ***H05B 3/12*** | (2006.01) |
| ***H05B 1/02*** | (2006.01) |
| ***H05B 3/14*** | (2006.01) |

(52) U.S. Cl.
CPC ..... *H05B 3/141* (2013.01); *H05B 3/34* (2013.01); *H05B 3/46* (2013.01); *H05B 3/52* (2013.01); *H05B 3/78* (2013.01); *H05B 2203/003* (2013.01); *H05B 2203/013* (2013.01); *H05B 2203/016* (2013.01); *H05B 2203/021* (2013.01)

(56) References Cited

U.S. PATENT DOCUMENTS

| | | | | |
|---|---|---|---|---|
| 3,284,174 | A * | 11/1966 | Zimmer | B23K 35/001 428/547 |
| 6,574,426 | B1 * | 6/2003 | Blanco, Jr. | F24H 1/102 392/485 |
| 2002/0000007 | A1 * | 1/2002 | Pittman | H05B 3/28 4/545 |
| 2006/0016802 | A1 | 1/2006 | Takamura et al. | |
| 2008/0237221 | A1 * | 10/2008 | Goto | H01L 21/67103 219/544 |
| 2009/0020518 | A1 * | 1/2009 | Ikeda | A47K 13/302 219/217 |

FOREIGN PATENT DOCUMENTS

| | | | | |
|---|---|---|---|---|
| JP | S57200261 | | * | 12/1982 |
| JP | H04-115797 | U | | 10/1992 |
| JP | H06-069241 | U | | 9/1994 |
| JP | H09-283197 | A | | 10/1997 |
| JP | H10-220876 | A | | 8/1998 |
| JP | H11-074063 | A | | 3/1999 |
| JP | 2005-114352 | A | | 4/2005 |
| JP | 2005114352 | A | * | 4/2005 |
| JP | 2005 183371 | | * | 7/2005 |
| JP | 2005-183371 | A | | 7/2005 |
| JP | 2005183371 | | * | 7/2005 |
| JP | 2006-059794 | A | | 3/2006 |
| JP | 2006-120559 | A | | 5/2006 |
| JP | 2006120559 | A | * | 5/2006 |

OTHER PUBLICATIONS

European Patent Office, Extended European Search Report issued in corresponding Application No. 15855716.5, dated Jun. 1, 2018.

Korean Intellectual Property Office, Office Action (Notification of Reason for Refusal) issued in corresponding Application No. 10-2017-7014204, dispatched date Apr. 19, 2018.

The State Intellectual Property Office of People's Republic of China, Office Action issued in corresponding Application No. 201580058128.6, dated Dec. 3, 2019.

* cited by examiner

SUS304

SUS430

CERAMIC HEATER AND MANUFACTURING METHOD FOR SAME

CROSS REFERENCE OF RELATED APPLICATION

The present international application claims priority of Japanese Patent Application No. 2014-223043, which was filed on Oct. 31, 2014, and the disclosure of which is hereby incorporated by reference in its entirety.

FIELD OF THE INVENTION

The present invention relates to a ceramic heater for use in a warm water washing toilet seat, a fan heater, an electric water heater, a 24-hour bath etc., and to a method for manufacturing the ceramic heater.

Herein, the expression "24-hour bath" refers to a circulation type bath capable of circulating hot water between a bathtub and a heating unit so as to, when the temperature of the circulated hot water becomes lowered, heat the circulated hot water as needed and thereby allow bathing at all times.

BACKGROUND ART

For example, a warm water washing toilet seat has a heat exchange unit equipped with a resin container (as a heat exchanger). In the heat exchange unit, a long pipe-shaped ceramic heater is disposed to heat washing water in the heat exchanger.

As such a ceramic heater, there is known a ceramic heater of the type having a cylindrical ceramic heater body and an annular plate-shaped ceramic flange fitted around the heater body and bonded to the heater body by a glass material.

Recently, there is proposed a ceramic heater of the type having a cylindrical ceramic heater body and an annular plate-shaped metal flange fitted around the heater body and bonded to the heater body by a brazing material for the purpose of improvements in air tightness and strength (bonding strength) between the heater body and the flange (see Patent Documents 1-2).

PRIOR ART DOCUMENTS

Patent Documents

Patent Document 1: Japanese Laid-Open Patent Publication No. H11-074063

Patent Document 2: Japanese Laid-Open Patent Publication No. H09-283197

SUMMARY OF THE INVENTION

Problems to be Solved by the Invention

In the case where the heater body and the flange are bonded together by the brazing material as mentioned above, however, there arises the problem that the bonding process is complicated.

More specifically, the ceramic heater body and the metal flange need to be brazed together by forming a metallized layer on a bonding area of the heater body, applying a plating layer to the metalized layer, applying a plating layer to a bonding area of the flange, and then, bonding the plating layer of the heater body to the plating layer of the flange via the brazing material.

For this reason, the manufacturing of the ceramic heater requires much expense in time and effort so that it is not easy to manufacture the ceramic heater.

In view of the foregoing, it is one desirable aspect of the present invention to provide an easy-to-manufacture ceramic heater with sufficient performance (such as air tightness and bonding strength) and a method for manufacturing such a ceramic heater.

Means for Solving the Problems (1) According to one aspect of the present invention, there is provided a ceramic heater comprising: a cylindrical heater body made of a ceramic material; and an annular flange made of a metal material and fitted around the heater body, wherein one side of the flange with respect to an axial direction of the heater body is concave in the axial direction to define a concave part; wherein the concave part includes a glass accumulation region filled with a glass material; and wherein the glass material in the glass accumulation region is fused to the flange and to the heater body.

In this ceramic heater, the glass material is filled in the glass accumulation region of the concave part of the flange and is fused to the heater body and the flange. The ceramic heater is thus manufactured by filling the glass accumulation region with the glass material and fusing the glass material to the heater body and the flange. It is therefore possible to easily manufacture the ceramic heater as compared with the case of using a conventional brazing bonding process.

Further, the glass material in the glass accumulation region is fused to an inner circumferential surface of the flange and an outer circumferential surface of the heater body over a wide area along the axial direction as compared with the case where a (conventional) plate-shaped flange is bonded only at a narrow inner circumferential surface of a through hole thereof to the heater body. It is therefore possible to effectively achieve the high air tightness and bonding strength between the heater body and the flange.

The expression "glass accumulation region" used herein refers to a region of the concave part in which the glass material can be accumulated (i.e. in which the glass material is filled and accumulated).

(2) In the above-mentioned ceramic heater, the flange may be formed from a plate into a cup-like shape with the concave part defined therein.

Namely, the flange may be formed by bending the plate into a cup-like shape with the concave part.

In this case, it is possible to easily form the flange by bending the plate into a cup-like shape through e.g. presswork.

(3) In the above-mentioned ceramic heater, a thermal expansion coefficient of the metal material of the flange may be higher than a thermal expansion coefficient of the ceramic material and a thermal expansion coefficient of the glass material of the heater body.

In the case where the thermal expansion coefficient of the metal material of the flange is higher than the thermal expansion coefficient of the ceramic material and the thermal expansion coefficient of the glass material of the heater body, stress is exerted by the outside flange onto the inside glass material and heater body in response to decrease from the temperature of fusing of the glass material (i.e. fusing temperature) to e.g. ambient temperature. It is thus possible to effectively improve the air tightness and bonding strength between the heater body and the flange.

Herein, the term "thermal expansion coefficient" refers to a thermal coefficient of expansion at the time of fusing of the glass material.

The thermal expansion coefficient of the metal material of the flange may be set to within the range of $100\times10^{-7}$ to $200\times10^{-7}$/K. The thermal expansion coefficient of the ceramic material of the heater body may be set to within the range of $50\times10^{-7}$ to $90\times10^{-7}$/K.

It is preferable that a thermal expansion coefficient of the glass material is higher than the thermal expansion coefficient of the ceramic material. In this case, it is possible to obtain further improvements in air tightness and bonding strength.

(4) In the above-mentioned ceramic heater, the glass material and the heater body may have compressive residual stress exerted by the flange.

It is advantageously possible to ensure the high air tightness and bonding strength between the heater body and the flange in the case where the compressive residual stress is exerted by the outside flange onto the inside glass material and heater body.

(5) In the above-mentioned ceramic heater, the metal material of the flange may contain Cr such that the amount of Cr present at a surface of the flange is larger than the amount of Cr present inside the flange.

Namely, Cr may be present (deposited) in a larger amount at the surface of the flange than inside the flange. The presence of Cr leads to improvement in glass wettability and thereby enables strong bonding of the glass material to the surface of the flange. It is thus possible to effectively improve the air tightness and bonding strength between the heater body and the flange. It is further advantageously possible to impart high corrosion resistance (e.g. acid resistance) in the case where a large amount of Cr is present at the surface of the metal flange.

Herein, Cr present at the surface of the flange may be in the form of not only Cr but also an oxide of Cr.

(6) In the above-mentioned ceramic heater, the flange may be made of stainless steel.

The stainless steel of high heat resistance and corrosion resistance is suitably usable as the metal material of the flange.

(7) In the above-mentioned ceramic heater, the heater body may have a groove formed in a surface thereof along the axial direction; and the flange may have, formed on an inner circumferential surface of a through hole thereof through which the heater body is inserted, a protrusion engageable in the groove.

The ceramic heater may be so structured that: the groove (slit) is formed in the surface of the heater body along the axial direction; and the protrusion is formed on the inner circumferential surface of the through hole of the flange so as to be engageable in the groove. In this case, the gap between the heater body and the flange is made smaller at a location corresponding to the groove as compared with the case where no protrusions are formed. It is thus possible to, at the time of fusing of the glass material, allow the molten glass material to easily flow along an inner circumferential surface of the groove and an outer circumferential surface of the protrusion and sufficiently fill the gap between the heater body and the flange with the glass material for further improvement in air tightness.

(8) In the above-mentioned ceramic heater, the glass material in the glass accumulation region may have a surface exposed to the outside in the axial direction and including a glass concave area with a curvature radius (R) ranging from ½ to 3/2 of a clearance between an inner diameter of the flange and an outer diameter of the heater body.

As is apparent from the after-mentioned experimental examples, it is advantageously possible to prevent the occurrence of cracking in the glass material, without causing excessive stress on the outer circumferential portion of the glass material, in the case where the curvature radius (R) of the glass concave area on the surface of the glass material (i.e. the depression in the surface of the glass material) is in the range of ½ to 3/2 of the clearance between the inner diameter of the flange and the outer diameter of the heater body.

(9) According to another aspect of the present invention, there is provided a ceramic heater manufacturing method for manufacturing the above-mentioned ceramic heater, comprising: fitting the flange around the heater body; filling the glass accumulation region of the flange with the glass material; and fusing the glass material to the flange and the heater body by heating and melting the glass material at a fusing temperature and then cooling the glass material.

In this ceramic heater manufacturing method, the glass material is fused to the flange and the heater body by, after fitting the flange around the heater body, filling the glass accumulation region of the flange with the glass material, heating and melting the glass material at a fusing temperature, and then, cooling the glass material.

Herein, the term "fusing temperature" refers to a temperature at which the glass material can be melted and be bonded to its surrounding members and hence corresponds to a melting temperature of the glass material. The fusing temperature of the glass material may be in the range from 900 to 1100° C.

(10) In the above-mentioned ceramic heater manufacturing method, the metal material of the flange may contain Cr so as to allow deposition of Cr at a surface of the flange by heating of the glass material at the fusing temperature.

As the glass material is heated at the fusing temperature, the flange with which the glass material is in contact is heated in the same manner. By such heating, Cr can be deposited at the surface of the flange.

<Configurations Applicable to Above Structural Members>

The metal material of the flange can be either a simple metal substance or a metal alloy. As such a metal material, stainless steel such as SUS 304 or SUS 430 (according to JIS) is usable. There can alternatively be used iron, copper, chromium, nickel, chromium steel, iron-nickel alloy, iron-nickel-cobalt alloy or the like.

As the ceramic material of the heater body, there can be used alumina, aluminum nitride, silicon nitride, zirconia, mullite or the like.

The heater body may have a heating element formed of e.g. tungsten. The heater body may be of the type containing the ceramic material as a main component.

The glass accumulation region in which the glass material is filled and accumulated may be formed with a depth of 1 to 20 mm (in the axial direction). The glass material may be provided with a depth of 2 mm or more.

As the glass material, there can be used $B_2O_3$—$SiO_2$—$Al_2O_3$ glass, $SiO_2$—$Na_2O$ glass, $SiO_2$—PbO glass, $SiO_2$—$Al_2O_3$—BaO glass or the like.

DESCRIPTION OF REFERENCE NUMERALS

Figure 1A:
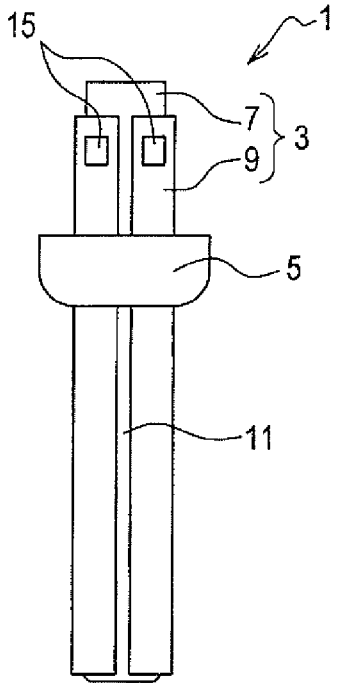
FIG. 1A is an elevation view of a ceramic heater according to a first embodiment of the present invention.

1, 51: Ceramic heater
3, 53: Heater body
5, 55: Flange
6, 56: Concave part
11, 63: Groove
23, 53, 67: Glass material
23*a*, 67*a*: Glass concave area
25, 58: Glass accumulation region
65: Protrusion

DESCRIPTION OF EMBODIMENTS

Ceramic heaters and ceramic heater manufacturing methods according to embodiments of the present invention will be described below.

First Embodiment a) First, the ceramic heater according to the first embodiment will be explained below.

The ceramic heater according to the first embodiment is designed for use in an exhaust exchanger of a heat exchange unit of e.g. a warm water washing toilet seat so as to heat washing water.

Figure 1B:
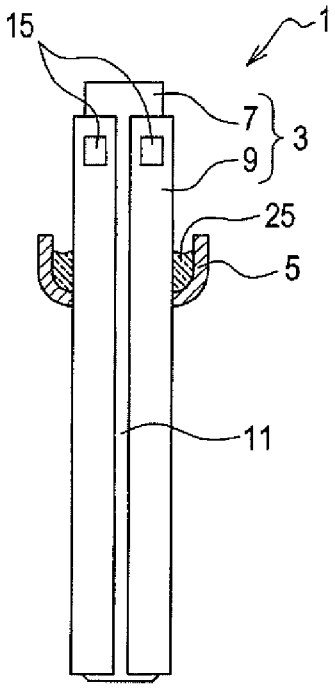
FIG. 1B is an elevation view of the ceramic heater with a part of the ceramic heater, including a flange and a glass material, cut away along an axial direction.
Figure 2:
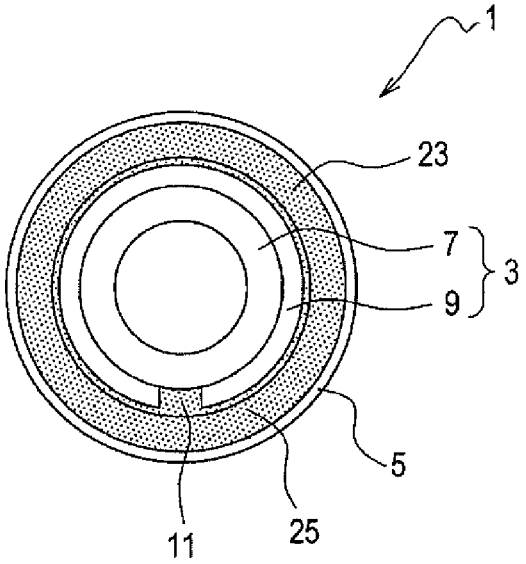
FIG. 2 is a plan view of the ceramic heater, with a perspective image of the glass material, according to the first embodiment of the present invention.

As shown in FIGS. 1A, 1B and 2, the ceramic heater 1 according to the first embodiment includes a cylindrical ceramic heater body 3 and an annular metal flange 5 fitted around the heater body 3.

The heater body 3 has a ceramic tube 7 formed with e.g. an outer diameter φ of 10 mm, an inner diameter φ of 8 mm and a length of 65 mm and a ceramic layer 9 formed with e.g. a thickness of 0.5 mm and a length of 60 mm so as to cover almost the entire outer circumference of the ceramic tube 7.

The ceramic tube 7 is however not entirely covered by the ceramic layer 9. A groove (slit) 11 of e.g. 1 mm width and 0.5 mm depth is formed in the ceramic layer 9 along an axial direction of the heater body.

Both of the ceramic tube 7 and the ceramic layer 9 (that is, the heater body 3) are made of alumina having a thermal expansion coefficient of e.g. $70\times10^{-7}$/K, which falls within the range of $50\times10^{-7}$ to $90\times10^{-7}$/K (as measured at 30 to 380° C.; the same applies to the following).

Figure 3:
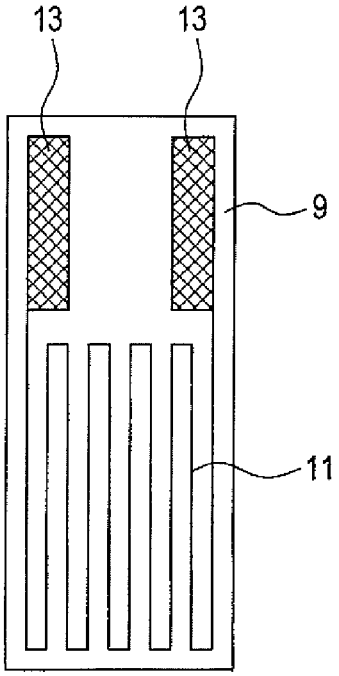
FIG. 3 is a schematic developed view of a heating element side of a ceramic layer of the ceramic heater according to the first embodiment of the present invention.

As shown in FIG. 3, a serpentine heating element 11 and a pair of inner terminals 13 are formed on an inner circumferential surface of the ceramic layer 9 (closer to the ceramic tube 7) or inside the ceramic layer 9. Further, outer terminals 15 (see FIGS. 1A and 1B) are formed on an outer circumferential surface of an end portion of the ceramic layer 9. The inner terminals 13 are electrically connected to the outer terminals 15 via through holes or via holes (not shown).

Figure 4A:
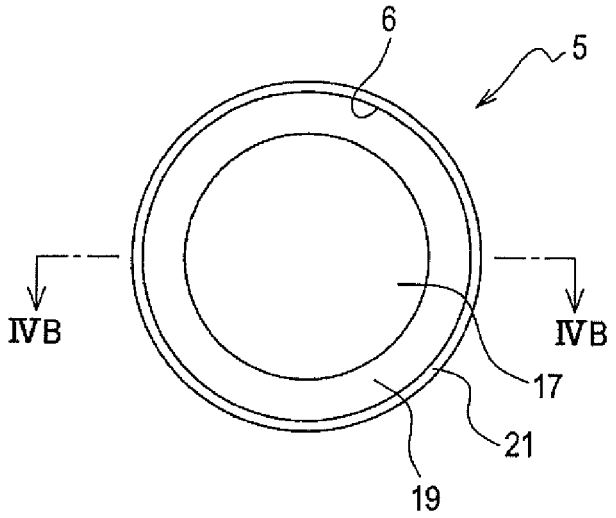
FIG. 4A is a plan view of the flange of the ceramic heater according to the first embodiment of the present invention.
Figure 4B:
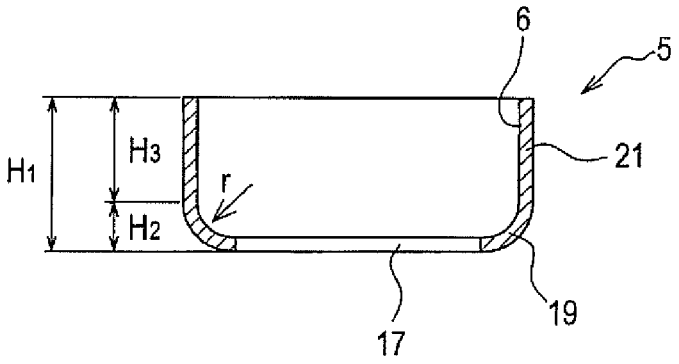
FIG. 4B is a cross-sectional view of the flange taken along line IVB-IVB of FIG. 4A.

As shown in FIGS. 4A and 4B, the flange 5 is an annular member of e.g. stainless steel and is formed into a concave shape (cup-like shape) by bending a center portion of a plate material toward one side (i.e. the lower side of FIG. 4B).

More specifically, the flange 5 is formed from a plate of e.g. 1 mm thickness such that a part of the flange is concave to define a concave part 6. One open end side (i.e. the upper side of FIG. 4B) of the concave part 6 is e.g. 16 mm in inner diameter φ; and the other open end side of the concave part 6 (i.e. the outer diameter of a through hole 17) is e.g. 12 mm in inner diameter φ.

The total height H1 of the flange 5 (in the vertical direction of FIG. 4B) is set to e.g. 6 mm. The flange 5 includes a bottom portion 19 curved with a radius r (e.g. 1.5 mm) and a cylindrical lateral portion 21 extending upward (i.e. in a direction along the axial direction) from the bottom portion 19. For example, the height H2 of the bottom portion 19 is set to 1.5 mm; and the height H3 of the lateral portion 21 is set to 4.5 mm. The expression "radius r" used herein refers to a radius of the curved bottom portion in a cross section taken along the axial direction.

The flange 5 has a thermal expansion coefficient of $178\times10^{-7}$/K (at 30 to 380° C.) in the case where the flange 5 is made of SUS 304 (containing Fe, Ni and Cr as main components). The flange 5 has a thermal expansion coefficient of $110\times10^{-7}$/K (at 30 to 380° C.) in the case where the flange 5 is made of SUS 430 (containing Fe and Cr as main components). In either case, the thermal expansion coefficient of the flange 5 falls within the range of $100\times10^{-7}$ to $200\times10^{-7}$/K (at 30 to 380° C.).

Figure 5:
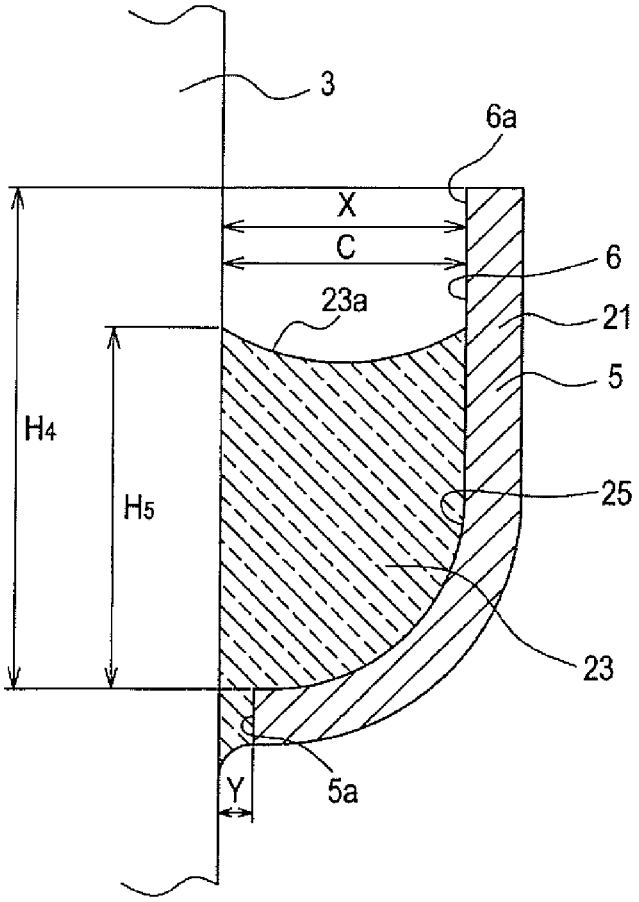
FIG. 5 is a schematic cross-sectional view of parts of the flange and the glass material of the ceramic heater, as taken along the axial direction, according to the first embodiment of the present invention.

In particular, a space surrounded by an outer circumferential surface of the heater body 3 and an inner circumferential surface of the flange 5 within the concave part 6 of the flange 5 is adapted as a glass accumulation portion 25 filled with a glass material 23 as shown by enlargement in FIG. 5. It is noted that the glass material 23 is indicated by fine dots in FIGS. 1A, 1B and 2.

The height H4 of the glass accumulation region 25 (in the vertical direction of FIG. 5) is set to e.g. 5 mm, which falls within the range of 1 to 20 mm. The width X of the glass accumulation region 25 in the lateral portion 21 (that is, the radial length of an upper opening 6*a* in FIG. 5) is set to e.g. 2 mm, which falls within the range of 1 to 20 mm.

In the glass accumulation region 25, the glass material 23 is filled up to a height greater than or equal to ⅓ of the height H4 of the glass accumulation region 25 and is fused to the heater body 3 and to the flange 5. The height H5 of the glass material 23 (more specifically, the height of an outer circumferential surface of the glass material in contact with the heater body 3 in the axial direction) is set to e.g. within the range of 1 to 19 mm.

There is a gap Y of e.g. 1 mm left between the heater body 3 and a lateral end face 5*a* of the lower portion of the flange 5. This gap Y is also filled with the glass material 23. Further, a part of the glass material 23 extends by a length of e.g. about 1 mm downward from the lower surface of the flange 5.

A clearance (gap) C between the inner diameter of the flange 5 and the outer diameter of the heater body 3 is made larger on the upper side of FIG. 5. In the lateral portion 21, the clearance C is in agreement with the width X.

The glass material 23 in the glass accumulation region 25 has, at a surface thereof (exposed to the outside; the upper side of FIG. 5), a glass concave area 23*a* curved with a curvature radius R. (Herein, the expression "curvature radius R" refers to a curvature radius of the glass concave area in a cross section taken along the axial direction).

The curvature radius R (e.g. 1.5 mm) of the glass concave area 23*a* is set to within the range of ½ to ⅔ of the clearance C between the inner diameter of the flange 5 and the outer diameter of the heater body 3. In the lateral portion 21, the width X and the clearance C are in agreement with each other.

As the glass material 23, $Al_2O_3$—$B_2O_3$—$SiO_2$ glass (called borosilicate glass) such as $Na_2O$—$Al_2O_3$—$B_2O_3$—$SiO_2$ glass is used in the first embodiment. This glass material 23 has a thermal expansion coefficient of e.g. $62\times10^{-7}$/K (at 30 to 380° C.), which falls within the range of $50\times10^{-7}$ to $90\times10^{-7}$/K (at 30 to 380° C.).

b) Next, the manufacturing method of the ceramic heater 1 according to the first embodiment will be explained below.

Figure 6F:
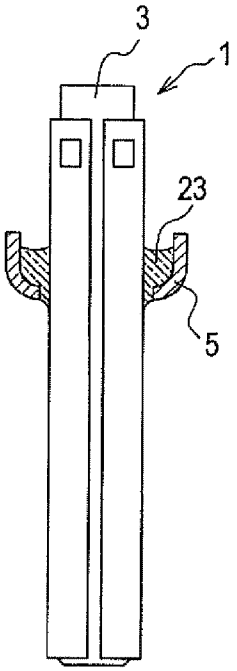
FIGS. 6A, 6B, 6C, 6D, 6E and 6F are schematic views of a method for manufacturing the ceramic heater according to the first embodiment of the present invention.
Figure 6E:
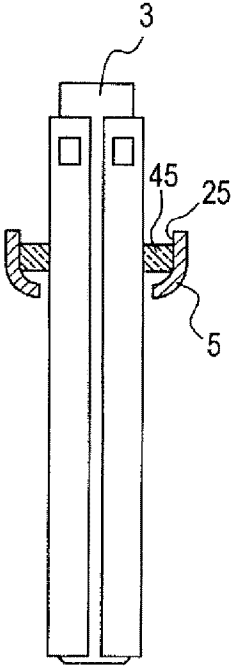
Figure 6D:
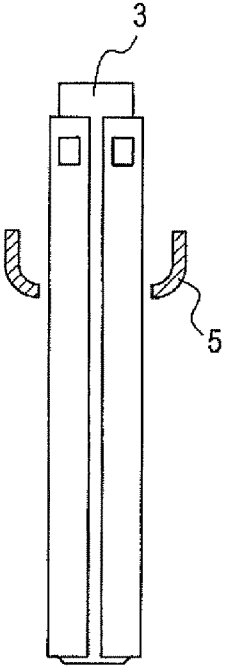
Figure 6C:
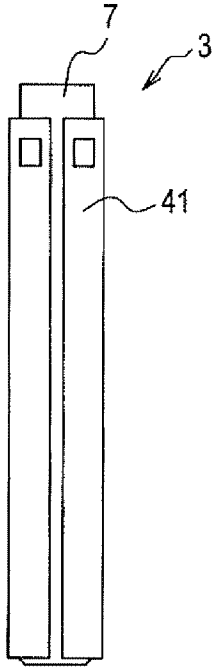
Figure 6B:
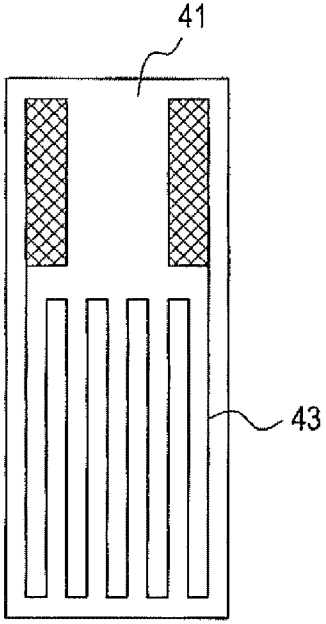
Figure 6A:
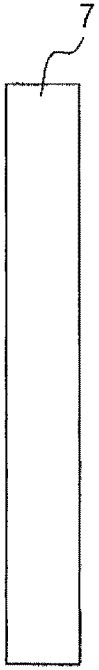

As shown in FIG. 6A, the ceramic tube 7 is formed in a pipe shape by calcination of alumina.

As shown in FIG. 6B, a pattern 43, which is to constitute the heating element 11 and the inner and outer terminals 13 and 15, is formed by printing of high-melting metal such as tungsten on a surface of a ceramic sheet 41 of alumina or inside a laminated ceramic sheet of alumina.

After a ceramic paste (e.g. alumina paste) is applied to the ceramic sheet 41, the ceramic sheet 41 is wrapped around and adhered to an outer circumferential surface of the ceramic tube 7 as shown in FIG. 6C. The ceramic tube 7 with the ceramic sheet 41 is then integrally fired. After that, Ni plating is applied to the outer terminals 15. There is thus obtained the heater body 3.

Further, the flange 5 is formed in a cup-like shape by presswork of e.g. stainless steel.

As shown in FIG. 6D, the flange 5 is fitted at a predetermined fitting position around the heater body 3 and secured with a jig.

The borosilicate glass as the glass material is formed into a ring shape by press work and calcined at 640° C. for 30 minutes, thereby providing a calcined glass material 45.

As shown in FIG. 6E, the ring-shaped calcined glass material 45 is placed in the glass accumulation region 25 between the heater body 3 and the flange 5.

In this state, the calcined glass material 45 is melted by heating at a fusing temperature (1015° C.) for 30 minutes in a reduction atmosphere (more specifically, an atmosphere of $N_2$+5% $H_2$). After that, the glass material is cooled to ambient temperature (e.g. 25° C.). In this way, the ceramic heater 1 where the glass material 25 is fused to the heater body 3 and the flange 5 is completed.

c) The effects of the first embodiment will be explained below.

In the first embodiment, the glass material 23 is filled in the glass accumulation region 25 of the concave part 6 of the flange 5 and is fused to the heater body 3 and to the flange 5.

The ceramic heater 1 is thus manufactured by filling the glass accumulation region 25 with the glass material 23 and fusing the glass material 23 to the heater body 3 and the flange 5. It is therefore possible to easily manufacture the ceramic heater 1 as compared with the case of using a conventional brazing bonding process.

Further, the glass material 23 in the glass accumulation region 25 is fused to the heater body 3 and the flange 5 over a wide area as compared with the case where a conventional plate-shaped flange is bonded to the heater body. It is therefore possible to effectively achieve the high air tightness and bonding strength between the heater body 3 and the flange 5.

It is further possible in the first embodiment to easily form the flange 5 by bending the plate into a cup-like shape through presswork etc.

In the first embodiment, the thermal expansion coefficient of the metal material of the flange 5 is set higher than the thermal expansion coefficient of the ceramic material of the heater body 3 and the thermal expansion coefficient of the glass material 23. Consequently, compressive residual stress is exerted by the flange 5 onto the glass material 23 and the heater body 3. It is thus advantageously possible to ensure the high air tightness and bonding strength between the heater body and the flange.

Furthermore, Cr is present (deposited) in a larger amount at the surface of the flange 5 than inside the flange 5 in the first embodiment. The presence of Cr leads to improvement in glass wettability and thereby enables strong bonding of the glass material 23 to the surface of the flange 5. It is thus possible to obtain improvements in not only air tightness and bonding strength but also corrosion resistance (e.g. acid resistance).

In the first embodiment, the curvature radius R of the glass concave area 23*a* on the surface of the glass material 23 is set to within the range of ½ to ⅔ of the clearance C between the inner diameter of the flange 5 and the outer diameter of the heater body 3. It is thus advantageously possible to prevent the occurrence of cracking in the glass material 23 without causing excessive stress on the outer circumferential portion of the glass material 23.

Second Embodiment

Next, the second embodiment will be explained below.

The ceramic heater according to the second embodiment is similar to the ceramic heater according to the first embodiment, except for the flange structure.

Figure 7:
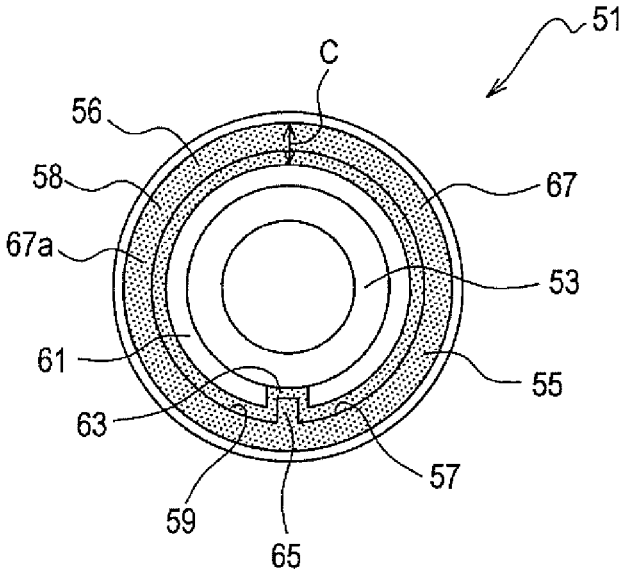
FIG. 7 is a plan view of a ceramic heater, with a perspective image of a glass material, according to a second embodiment of the present invention.

As shown in FIG. 7, the ceramic heater 51 according to the second embodiment includes a cylindrical ceramic heater body 53 and an annular cup-like shaped metal flange 55 (having one side concave in the axial direction) fitted around the heater body 53.

As in the case of the first embodiment, a concave part 56 of the flange 55 includes a glass accumulation region 58 filled with a glass material 67; and the glass material 67 is fused to the heater body 53 and to the flange 55. A thermal expansion coefficient of the metal material of the flange 55 is set higher than a thermal expansion coefficient of the ceramic material of the heater body 53 and a thermal expansion coefficient of the glass material 67. Further, Cr is present in a larger amount at the surface of the flange 55 than inside the flange 55. The curvature radius R of a glass concave area 67*a* on the surface of the glass material 67 is set to within the range of ½ to ⅔ of a clearance C between the inner diameter of the flange 55 and the outer diameter of the heater body 53.

In particular, a protrusion 65 is formed on an inner circumferential surface of a through hole 59 of a bottom portion 57 of the flange 55 so as to be engaged in a groove 63 of a ceramic layer 61 of the heater body.

It is thus possible to, at the time of fusing of the glass material 67 as indicated by fine dots in the figure, allow the molten glass material 67 to easily flow along an inner circumferential surface of the groove 63 and an outer circumferential surface of the protrusion 65 and tightly fill the gap between the heater body 53 and the flange 55 with the glass material 67 for further improvement in air tightness.

EXPERIMENTAL EXAMPLES

The following explanation will be given of various experimental examples made to verify the effects of the present invention.

Experimental Example 1

In Experimental Example 1, a leakage test of the bonded part (fused part) of the glass material was performed with the use of a known He leakage detector so as to examine the air tightness of the bonded part of the glass material.

As test samples, ceramic heaters of the same structure as that of the first embodiment were prepared by varying the material of the flange as shown in TABLE 1 (sample No. 1 to 4). In the test samples, two production lots of glass materials were used.

Figure 8:
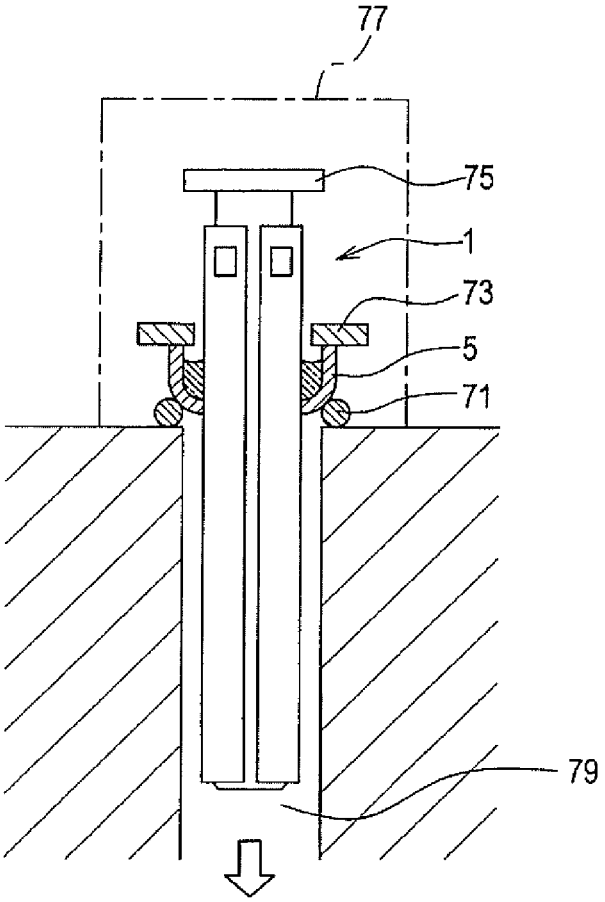
FIG. 8 is a schematic view of a device used in Experimental Example 1 to test the amount of He leakage.

As shown in FIG. 8, each of the ceramic heater samples 1 was set by placing an O-ring 71 below the flange 5 and pushing the flange 5 downward by a pushing member 73. An upper end of the ceramic heater 1 was closed by a plate 75.

In this state, the ceramic heater was subjected to vacuum (of the order of $10^{-7}$ Pa) through a slotted hole 79 in which a lower portion of the ceramic heater 1 was arranged; and He was introduced to the inside of a container 77 by which an upper portion of the ceramic heater 1 was covered. Then, the amount of leakage of He was measured by the He leakage detector.

In this measurement test, five samples for each material were prepared and tested for the leakage amount. The test results are shown in TABLE 1.

Conventional ceramic heaters with metal flanges were prepared as comparative samples (sample No. 5 and 6) and tested for the leakage amount in the same manner as above. Herein, each of the conventional ceramic heaters was of the type obtained by forming the annular plate-shaped flange from stainless steel, applying a Ni plating layer to the flange, forming a metallized layer on an outer circumference of the heater body, applying a Ni plating layer to the metalized layer, and then, bonding the Ni plating layer of the heater body and the plating layer of the flange via a Ag brazing material. The test results are also shown in TABLE 1

TABLE 1

| | | Leakage Amount ($\times 10^{-9}$ Pa · $m^3$/sec or less) | | | | | | |
|---|---|---|---|---|---|---|---|---|
| | | 1 | 2 | 3 | 4 | 5 | Average | Remarks |
| 1 | SUS 304 | 0.15 | 2.9 | 0.22 | 3.6 | 4.1 | 2.194 | glass lot A |
| 2 | SUS 430 | 1.9 | 11 | 0.73 | 3.2 | 1.6 | 1.706 | glass lot A |
| 3 | SUS 304 | 3.2 | 15 | 0.9 | 2 | 1.5 | 1.82 | glass lot B |
| 4 | SUS 430 | 5.5 | 6.5 | 7 | 0.06 | 0.7 | 3.952 | glass lot B |
| 5 | SUS 304 | 4.5 | 7 | 0.16 | 4.3 | — | 9.99 | brazing |
| 6 | SUS 430 | 6.9 | 3.2 | 6 | 2.4 | — | 4.625 | brazing |

As shown in TABLE 1, each of the test samples (No. 1 to 4) of the ceramic heater according to the present invention had a very small leakage amount of the order of $10^{-9}$ Pa·$m^3$/sec or smaller.

It is thus apparent that the ceramic heater according to the present invention has as high air tightness as that of the conventional ceramic heater obtained by brazing.

Experimental Example 2

In Experimental Example 2, the bonding strength between the heater body and the glass material was examined.

As a test sample (sample No. 7), a ceramic heater of the same structure as that of the first embodiment was prepared by using SUS 304 as the material of the flange.

While holding the ceramic heater sample in a vertical position and securing the bottom surface of the flange, a load was applied to the ceramic tube from the top side so as to punch the ceramic tube away from the flange. The load with which the ceramic tube was punched away (i.e. the punching strength) was measured.

A conventional ceramic heater with a ceramic flange was prepared as a comparative sample (sample No. 8) and tested for the punching strength in the same manner as above. Herein, the conventional ceramic heater was of the type obtained by forming the flange from a plate of alumina into a square plate shape (one side length: 30 mm, inner diameter φ: 12 mm, thickness: 4 mm) and bonding a heater body to an inner circumferential surface of the flange via a glass material.

The test results are shown in TABLE 2.

TABLE 2

| | Type of Flange | Punching Strength (kN) |
|---|---|---|
| 7 | cup-like shaped metal flange | 8.3 |
| 8 | plate-shaped ceramic flange | 3.1 |

As shown in TABLE 2, the test sample of the ceramic heater according to the present invention had higher punching strength than that of the comparative sample. It is thus apparent that the ceramic heater according to the present invention had higher bonding strength than that of the conventional ceramic heater.

Experimental Example 3

In Experimental Example 3, an acid resistance test of the ceramic heater was performed.

Test samples were prepared by forming flanges of SUS 304 and SUS 430 and heating these flanges for 30 minutes at 1015° C.

Then, each of the test samples was tested by the acid resistance test. In the acid resistance test, the sample was exposed to an atmosphere of hydrochloric acid vapor for 100 hours by putting 1 L of 10% hydrochloric acid in a 10-L closed container and hanging the sample in a hollow space within the container.

As a result, there were seen no changes in the appearance and He leakage amount of the test sample before and after the acid resistance test. It is thus apparent that the flange according to the present invention has high acid resistance.

Experimental Example 4

In Experimental Example 4, a thermal shock resistance test of the ceramic heater was performed.

As test samples (sample No. 9), ten ceramic heaters of the same structure as that of the first embodiment were prepared by using SUS 304 as the material of the flange.

Five each out of the ten samples were heated at respective predetermined temperatures shown in TABLE 3. After the heating, the test samples were each put into water of ambient temperature (25° C.). The occurrence of cracking in the glass material was checked. Further, the test samples which had been put into water were tested for the leakage amount in the same manner as in Experimental Example 1.

The test results are shown in TABLE 3. Herein, the occurrence of cracking in the glass material was checked by visual inspection; and the occurrence of leakage failure was judged when the He leakage amount of the test sample was more than $1\times10^{-8}$ Pa·m$^3$/sec.

TABLE 3

| | Heating Temperature | Water Temp. + 150° C. | Water Temp. + 160° C. |
|---|---|---|---|
| 9 | Occurrence of Cracking | none | none |
| | Number of Leakage Failures | 0/5 | 0/5 |

It is apparent from TABLE 3 that the ceramic heater according to the present invention had high thermal shock resistance.

Experimental Example 5

In Experimental Example 5, changes of the surface composition of the flange due to variations in firing temperature were examined.

Using flanges of SUS 304 and SUS 430, five test samples for each flange type were prepared. These test samples were heated for 30 minutes at firing temperatures shown in FIGS. 9A and 9B.

An elemental mass analysis was performed on each of the test samples by energy-dispersive x-ray spectrometry to determine the mass % of the respective elements. The analysis results are shown in FIGS. 9A and 9B.

Figure 9A:
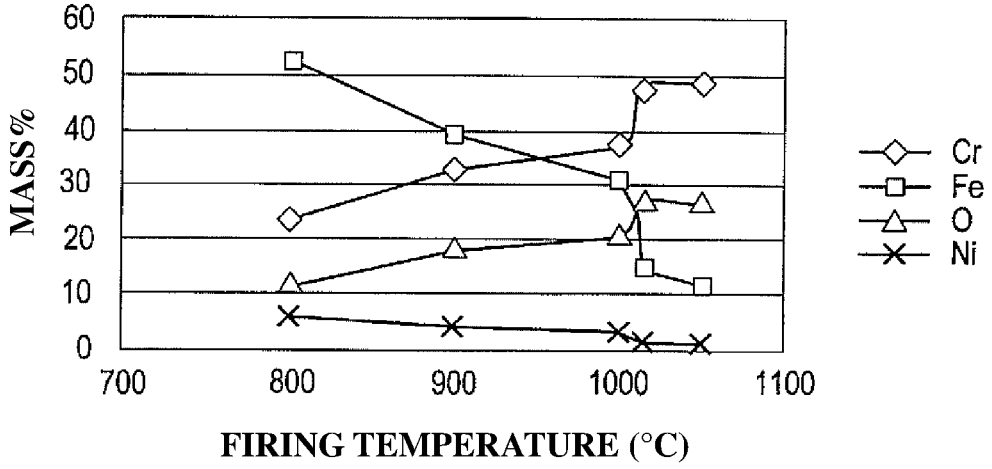
FIG. 9A is a graph showing the relationship between a firing temperature of the flange and respective component mass % at a surface of the flange after firing in the case of the flange being formed from SUS 304.
Figure 9B:
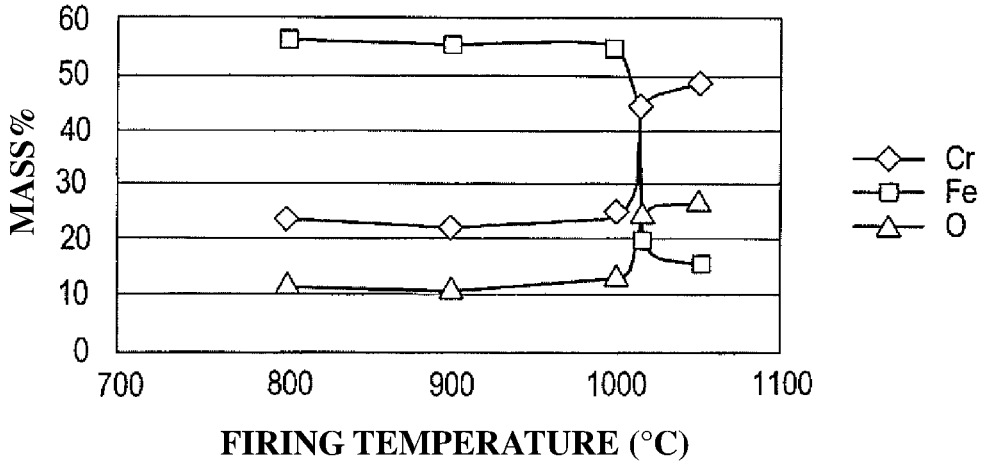
FIG. 9B is a graph showing the relationship between a firing temperature of the flange and respective component mass % at a surface of the flange after firing in the case of the flange being formed from SUS 430.

As shown in FIGS. 9A and 9B, there were observed increases of Cr and O contents at around a firing temperature of 1000° C. The reason for such increases is assumed that an oxide of Cr (e.g. a passive layer of Cr) was formed at the surface of the flange.

Experimental Example 6

In Experimental Example 6, changes of the surface principle stress of the glass material were studied by simulation.

More specifically, a stress simulation experiment was performed on the ceramic heater according to the present invention under the following conditions using an analysis software ANSYS APDL 15.0.

<Ceramic Material (Heater Body)>
Young's modulus: 280 GPa
Poisson's ratio: 0.3
Linear expansion coefficient: 6.8 ppm/K
<Glass Material>
Young's modulus: 60 GPa
Poisson's ratio: 0.3
Linear expansion coefficient: 6.2 ppm/K
<Metal Material (Flange)>
Young's modulus: 200 GPa
Poisson's ratio: 0.3
Linear expansion coefficient: 18.1 ppm/K
<Analysis Conditions>
Two-dimensional axisymmetric model
Static analysis Assuming the glass material to be in a stress-free state (where no stress was exerted) at 693° C. (glass softening point), the stress on the glass material when cooled to 25° C. was evaluated.

The simulation results are shown in FIGS. 10A to 10D. In FIGS. 10A to 10D, the gray (shaded) part designates the zone of compressive stress (compressive residual stress); and the dark gray (fine meshed) part designates the zone of tensile stress (surface principle stress). Further, the relationship between the tensile stress (surface principle stress) and the curvature radius R of the glass concave area is shown in FIG. 11 and TABLE 4. In FIG. 11, the surface principle stress (HS) refers to a tensile stress exerted on the vicinity of the surface of the outer circumferential surface of the glass material (e.g. the fine meshed part indicated by an arrow in FIG. 10C).

Figure 10A:
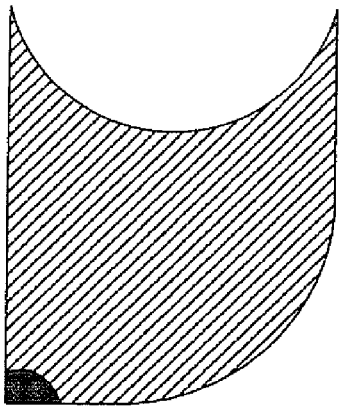
FIGS. 10A, 10B, 10C and 10D are charts for explaining a simulation experiment performed in Experimental Example 6 to test the relationship between a curvature radius of a glass concave area of the glass material and tensile stress on a surface of the glass material (i.e. surface principle stress).
Figure 10B:
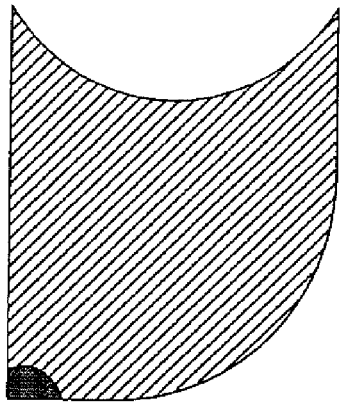
Figure 10C:
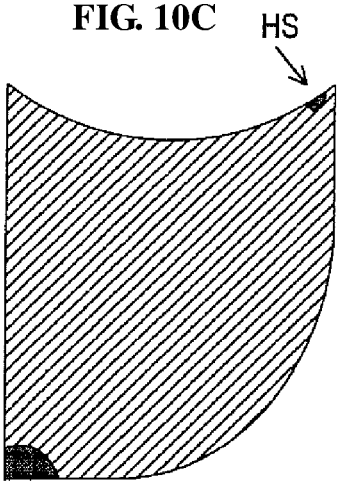
Figure 10D:
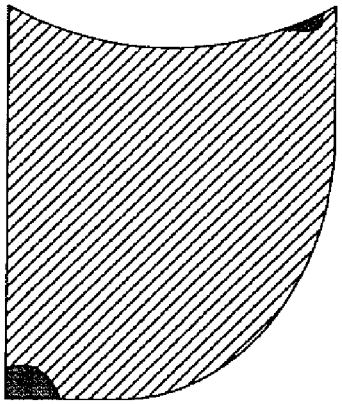
Figure 11:
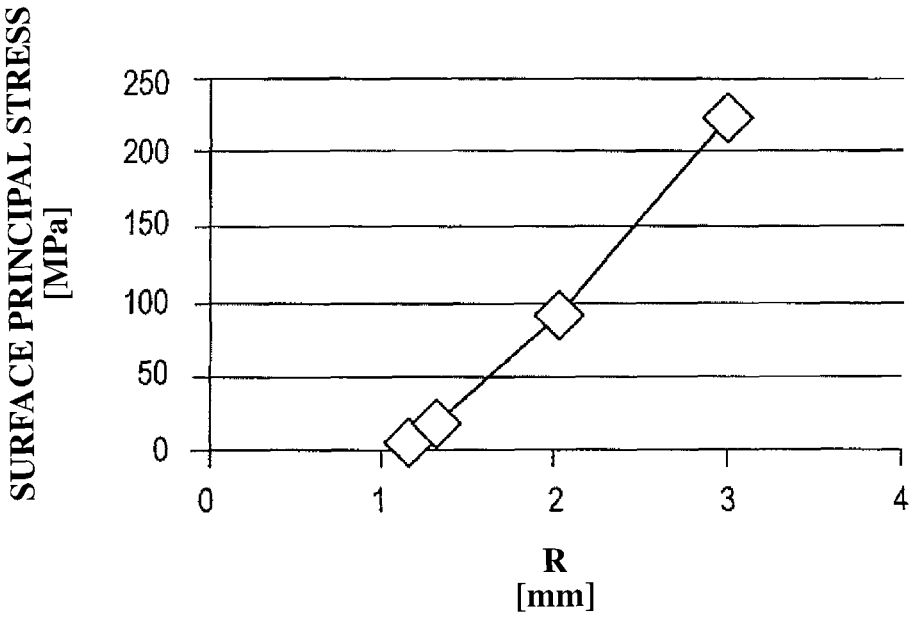
FIG. 11 is a graph showing the results of the simulation experiment performed in Experimental Example 6 to test the relationship between the curvature radius of the glass concave area and the surface principle stress.

FIG. 10A corresponds to the case where: the curvature radius R was 1.2 mm; the width X of the glass accumulation region was 2.4 mm; and the height H5 of the glass material was 3 mm. FIG. 10B corresponds to the case where: the curvature radius R was 1.3 mm; the width X of the glass accumulation region was 2.4 mm; and the height H5 of the glass material was 3 mm. FIG. 10C corresponds to the case where: the curvature radius R was 2 mm; the width X of the glass accumulation region was 2.4 mm; and the height H5 of the glass material was 3 mm. FIG. 10D corresponds to the case where: the curvature radius R was 3 mm; the width X of the glass accumulation region was 2.4 mm; and the height H5 of the glass material was 3 mm.

The clearance C, which was equal to the width X of the glass accumulation region, was set to a constant value of 2.4 mm.

TABLE 4

| Curvature Radius R (mm) | Surface Principle Stress (MPa) | Clearance C (mm) | R-C Relationship |
|---|---|---|---|
| 1.2 | 6.61 | 2.4 | R = (1/2) · C |
| 1.3 | 17.56 | 2.4 | R = (1.1/2) · C |
| 2 | 91.02 | 2.4 | R = (1.7/2) · C |
| 3 | 226.22 | 2.4 | R = (2.5/2) · C |

It is apparent from FIGS. 10A to 10D, FIG. 11 and TABLE 4, the larger the curvature radius R, the larger the surface principle stress, the more susceptible the glass material was to breakage.

It is also apparent from FIGS. 10A to 10D, FIG. 11 and TABLE 4 that, when the curvature radius R of the glass concave area was in the range of 1/2 to 3/2 of the clearance between the inner diameter of the flange and the outer diameter of the heater body, the surface principle stress was small so that the glass material was less susceptible to breakage.

Experimental Example 7

In Experimental Example 7, the presence of compressive stress on the glass material and the heater body after the fusing of the glass material was examined.

Two kinds of ceramic heaters of the same structure as that of the first embodiment were prepared. More specifically, SUS 304 or SUS 430 was used as the material of the flange; and the other configurations of the test samples were the same as those of the first embodiment.

On each of the test samples, stress remaining inside the flange at a position in the vicinity of the lateral end portion 5*a* as shown in FIG. 5 was measured by micro X-ray analysis (side inclination method, φ0 constant method). The measurement was performed at six points on each sample. The average of the measurement results was obtained.

In the case where the flange was of SUS 304, the average residual stress of the sample was 337 MPa. The average residual stress of the sample was 150 MPa in the case where the flange was of SUS 430. In either case, the residual stress was compressive stress.

It is apparent that, as the thermal expansion coefficients of the glass material and the heater body were lower than the thermal expansion coefficient of the flange, compressive stress was exerted on the glass material and the heater body after the fusing of the glass material.

Although the present invention has been described with reference to the above specific embodiments, the present invention is not limited to those specific embodiments and can be embodied in various forms. The present invention is applicable to ceramic heaters for not only warm water washing toilet seat, but also fan heater, electric water heater, 24-hour bath etc., and manufacturing methods thereof.

What is claimed is:

1. A ceramic heater comprising:

a cylindrical heater body made of a ceramic material; and an annular flange made of a metal material and fitted around the heater body such that the heater body passes through the flange, wherein one side of the flange with respect to an axial direction of the heater body is concave in the axial direction to define a concave part with the flange having a bottom portion and a lateral portion extending from the bottom portion along the axial direction, the bottom portion having a thickness taken in the axial direction the same as a thickness taken perpendicular to the axial direction of the lateral portion;

wherein the concave part includes a glass accumulation region filled with a glass material;

wherein the glass material in the glass accumulation region is fused to the flange and to the heater body; and wherein the glass material in the glass accumulation region has a surface exposed to the outside in the axial direction and including a glass concave area with a curvature radius (R) ranging from ½ to ⅜ of a clearance between an inner diameter of the lateral portion of the flange and an outer diameter of the heater body.

2. The ceramic heater according to claim 1, wherein a thermal expansion coefficient of the metal material of the flange is higher than a thermal expansion coefficient of the ceramic material and a thermal expansion coefficient of the glass material.

3. The ceramic heater according to claim 1, wherein the glass material and the heater body have compressive residual stress exerted by the flange.

4. The ceramic heater according to claim 1, wherein the metal material of the flange contains chromium such that the amount of chromium present at a surface of the flange is larger than the amount of chromium present inside the flange.

5. The ceramic heater according to claim 1, wherein the flange is made of stainless steel.

6. The ceramic heater according to claim 1, wherein the heater body has a groove formed in a surface thereof along the axial direction; and wherein the flange has, formed on an inner circumferential surface of a through hole thereof through which the heater body is inserted, a protrusion engageable in the groove.

7. The ceramic heater according to claim 1, wherein the bottom portion of the flange is curved.

8. The ceramic heater according to claim 1, wherein, where the heater body passes through the flange, a gap is defined between the bottom portion of flange and the heater body and the gap is filled with the glass material.

9. The ceramic heater according to claim 8, wherein the glass material extends through the gap a distance below a lower surface of the bottom portion of the flange.

10. The ceramic heater according to claim 1, wherein the thickness of the bottom portion is 1 mm and the thickness of the lateral portion is 1 mm.

11. The ceramic heater according to claim 1, wherein the bottom portion of the flange is curved or angular with a height in the axial direction less than a height of the lateral portion in the axial direction.

12. A ceramic heater manufacturing method for manufacturing a ceramic heater including a cylindrical heater body made of a ceramic material and an annular flange made of a metal material and fitted around the heater body such that the heater body passes through the flange, wherein one side of the flange with respect to an axial direction of the heater body is concave in the axial direction to define a concave part, wherein the concave part includes a glass accumulation region filled with a glass material, and wherein the glass material in the glass accumulation region is fused to the flange and to the heater body, the ceramic heater manufacturing method comprising:

fitting the flange around the heater body;

filling the glass accumulation region of the flange with the glass material; and fusing the glass material to the flange and the heater body by heating and melting the glass material at a fusing temperature and then cooling the glass material, wherein the glass material in the glass accumulation region has a surface exposed to the outside in the axial direction and including a glass concave area with a curvature radius (R) ranging from ½ to ⅜ of a clearance between an inner diameter of the flange and an outer diameter of the heater body.

13. The ceramic heater manufacturing method according to claim 12, wherein the metal material of the flange contains chromium so as to allow deposition of chromium at a surface of the flange by heating of the glass material at the fusing temperature.

14. The ceramic heater manufacturing method according to claim 12, comprising providing the annular flange as a plate of the metal material and bending the plate to form the annular flange with the concave part.

15. The ceramic heater manufacturing method according to claim 12, wherein the flange has a cup shape including a curved or angular bottom portion with a height taken in the axial direction less than a height of a lateral portion extending from the bottom portion along the axial direction, the height of the lateral portion taken in the axial direction.

16. The ceramic heater manufacturing method according to claim 12, wherein the heater body includes terminals and a heating element and with respect to the axial direction of the heater body, the terminals are positioned above an upper side of the flange and the heating element is positioned below a lower side of the flange, and wherein the upper side of the flange is concave upward in the axial direction.

17. The ceramic heater manufacturing method according to claim 12, wherein a thermal expansion coefficient of the metal material of the flange is higher than a thermal expansion coefficient of the ceramic material and a thermal expansion coefficient of the glass material such that upon cooling, the glass material and the heater body have compressive residual stress exerted by the flange.

* * * * *